US005525403A

United States Patent [19]

Kawabata et al.

[11] Patent Number: 5,525,403

[45] Date of Patent: Jun. 11, 1996

[54] THERMAL TRANSFER PRINTING MEDIUM

[75] Inventors: Hitomi Kawabata; Tomoaki Yamanaka; Yasuo Tago, all of Osaka; Shinya Yamamoto; Tsuneo Kawabata, both of Kyoto, all of Japan

[73] Assignee: Fujicopian Co., Ltd., Osaka, Japan

[21] Appl. No.: 306,768

[22] Filed: Sep. 15, 1994

[30] Foreign Application Priority Data

Sep. 17, 1993 [JP] Japan ..... 5-231742

[51] Int. Cl.[6] ..... B41M 5/30; B41M 5/40

[52] U.S. Cl. ..... 428/212; 428/195; 428/209; 428/484; 428/488.1; 428/488.4; 428/913; 428/914; 503/204; 503/226

[58] Field of Search ..... 428/195, 484, 428/488.1, 488.4, 913, 914, 209, 212; 503/204, 226

[56] References Cited

FOREIGN PATENT DOCUMENTS

| | | | |
|---|---|---|---|
| 0257499 | 3/1988 | European Pat. Off. | B41M 5/26 |
| 0263478 | 4/1988 | European Pat. Off. | B41M 5/26 |
| 0542208 | 5/1993 | European Pat. Off. | B41M 5/38 |
| 4-144790 | 5/1992 | Japan | B41M 5/40 |

*Primary Examiner*—Pamela R. Schwartz
*Attorney, Agent, or Firm*—Fish & Neave

[57] ABSTRACT

A thermal transfer printing medium is provided which includes a foundation, and a transfer layer provided on one side of the foundation and comprising a heat-meltable color ink layer, a heat-meltable transparent ink layer, a metal deposition layer and an adhesive layer which are stacked in that order from the foundation side. The thermal transfer printing medium is capable of forming print images in a color inherent to the color ink layer, free from the influences of the color of the image-receiving medium and the metal deposition layer serving as a hiding layer.

6 Claims, No Drawings

THERMAL TRANSFER PRINTING MEDIUM

BACKGROUND OF THE INVENTION

The present invention relates to thermal transfer printing media and, more particularly, to a thermal transfer printing medium useful in printing images onto a colored image-receiving medium.

Conventionally, the thermal transfer technology has been utilized for forming print images solely on white paper sheets. Recently, however, the thermal transfer technology has found increasing applications such as in forming heading labels, name labels and backbone labels.

In these applications, printed images are frequently formed on colored image-receiving media; for instance, white characters are formed on a black image-receiving medium.

A conventional thermal transfer printing medium having a white heat-meltable ink layer, however, has been able to provide only grayish print images when used in printing onto a black image-receiving medium.

Such a conventional white heat-meltable ink layer typically employs titanium oxide as a white pigment. Although titanium oxide per se has a great hiding power, limitations are imposed on the content of titanium oxide in the heat-meltable ink layer and the thickness of the ink layer for ensuring a satisfactory transferability of the ink layer and, hence, the hiding power of the whole ink layer cannot be enhanced.

On the other hand, there has been proposed in the prior art the enhancement of print density by providing a metal deposition layer on a color ink layer of a thermal transfer printing medium to cut off reflected light from a recording paper sheet (refer to Japanese Unexamined Patent Publication No. 92492/1988).

Print images provided by this thermal transfer printing medium are surely not affected by the color of an image-receiving medium, but the images are influenced by the metal deposition layer serving as a hiding layer. For this reason, such a thermal transfer printing medium still involves a problem of impossibility of providing print images in a color inherent to the color ink layer. Specifically, where the metal deposition layer is an aluminum deposition layer and the color ink layer is, for example, a white ink layer, resulting print images are in a grayish color with their whiteness degraded.

In view of the foregoing, it is an object of the present invention to provide a thermal transfer printing medium capable of forming print images which are affected by neither the color of an image-receiving medium nor a metal deposition layer serving as a hiding layer and which are in a color inherent to a color ink layer.

This and other objects of the present invention will become apparent from the description hereinafter.

SUMMARY OF THE INVENTION

According to the present invention, there is provided a thermal transfer printing medium comprising a foundation, and a transfer layer provided on one side of the foundation and comprising a heat-meltable color ink layer, a heat-meltable transparent ink layer, a metal deposition layer and an adhesive layer which are provided in that order from the foundation side.

When a print image is formed on an image-receiving medium using a thermal transfer printing medium of the above arrangement, the print image is of layered strucuture wherein the adhesive layer, metal deposition layer, transparent ink layer and color ink layer are stacked in that order from the image-receiving medium side.

With this layered structure, the presence of the metal deposition layer having a great hiding power under the color ink layer prevents the color of the print image from being affected by the color of the image-receiving medium.

Further, the presence of the transparent ink layer intermediate the color ink layer and the metal deposition layer prevents the metal deposition layer from affecting the color of the color ink layer thereby providing the original color of the color ink layer to the print image, though the reason therefor is undetermined. Where the color ink layer is, for example, a white ink layer, a resulting print image exhibits an excellent whiteness.

DETAILED DESCRIPTION

The heat-meltable color ink layer in the present invention may be any conventionally known one comprising a coloring agent and a heat-meltable vehicle without particular limitations. The color ink layer herein is meant to include an achromatic color ink layer such as a white or black ink layer as well as a chromatic ink layer.

Usable as the coloring agent are various inorganic or organic pigments, fluorescent pigments and the like.

Examples of white pigments include titanium oxide and calcium carbonate.

Examples of yellow pigments include Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake.

Examples of red pigments include Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y and Arizalin Lake.

Examples of blue pigments include Victoria Blue Lake, metal-free Phthalocyanine Blue, Phthalocyanine Blue and Fast Sky Blue.

These pigments may be used either alone or in combination. A dye may be used for color adjustment.

The content of the coloring agent in the color ink layer is suitably in the range of about 10 to about 90% (% by weight, hereinafter the same), preferably about 50 to about 90%. According to the present invention, the provision of the transparent ink layer between the color ink layer and the metal deposition layer makes it possible to increase the content of a coloring agent in the color ink layer up to such a range of about 50 to about 90%, thereby ensuring the desired hiding power of the color ink layer.

The heat-meltable vehicle may be any heat-meltable vehicle comprised of a heat-meltable resin and/or a wax.

Examples of the aforesaid heat-meltable resin include polyester resins, polyamide resins, polyurethane resins, ethylene-vinyl acetate copolymers, vinyl chloride-vinyl acetate copolymers, vinyl chloride-vinyl acetate-maleic acid terpolymers, polyvinyl butyrals, α-olefin-maleic anhydride copolymers, ethylene-(meth)acrylic acid ester copolymers, low-molecular-weight styrene resins, ethylene-styrene copolymers, styrene-butadiene copolymers, petroleum resins, rosin resins, terpene resins, polypropylene resins and ionomer resins. These resins may be used either alone or in combination.

Examples of the aforesaid wax include natural waxes such as haze wax, bees wax, lanolin, carnauba wax, candelilla wax, montan wax and ceresine wax; petroleum waxes such as paraffin wax and microcrystalline wax; synthetic waxes such as oxidized wax, ester wax, low-molecular-weight polyethylene wax, Fischer-Tropsch wax and α-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes may be used either alone or in combination.

Where there is desired a print image excellent in properties such as scratch resistance or abrasion resistance, the vehicle preferably contains a heat-meltable resin as a main component. More preferably the vehicle is comprised solely of a heat-meltable resin.

Usually, the softening point and coating amount (on a dry weight basis, hereinafter the same) of the color ink layer are appropriately selected from the range of 60° to 130° C. and the range of 2 to 6 g/m$^2$, respectively, in view of the transferability of the ink layer.

The heat-meltable transparent ink layer in the present invention is a layer comprising a heat-meltable material as a main component and substantially free of any coloring agent.

The heat-meltable material can be any of those heat-meltable materials comprising a heat-meltable resin and/or a wax. Any heat-meltable resins and waxes as aforementioned for the color ink layer are usable for these heat-meltable resin and/or wax.

Where there is desired a print image excellent in properties such as scratch resistance or abrasion resistance, the heat-meltable material preferably contains a heat-meltable resin as a main component. More preferably the heat-meltable material is comprised solely of a heat-meltable resin.

Preferably, the transparent ink layer has an average light transmittance of 70% or higher, particularly 80% or higher in the visible region. When the light transmittance of the transparent ink layer is lower than the foregoing, the color of a resulting print image will not so sufficiently reflect the original color of the color ink layer.

The transparent ink layer may be colored in a color of the same type as that of the color ink layer within a range such as not to degrade the aforementioned transmittance thereof.

The coating amount of the transparent ink layer is preferably 0.1 g/m$^2$ or greater, especially 0.3 g/m$^2$ or greater. If the coating amount is less than that range, it is hard to provide a print image in a color inherent to the color ink layer because of the influence of the color of the metal deposition layer. If the coating amount of the transparent ink layer is too much, the transferablity of the transfer layer degrades. From this point of view, the coating amount of the transparent ink layer is preferably 2 g/m$^2$ or less.

The softening point of the transparent ink layer is suitably 60° to 130° C. from the viewpoint of transferability.

When the transparent ink layer is poor in selective transferability, fine particles may be added thereto within a range such as not to degrade the aforementioned light transmittance. The selective transferability herein is meant by a property such that only a heated portion of a layer is transferred but an unheated portion in the periphery of the heated portion is not transferred. Such fine particles have to be those of good transparency including, for example, colloidal silica, alumina and titanium oxide which are used either alone or as a mixture.

The present invention can use aluminum, zinc, tin, nickel, chromium, titanium, copper, silver or the like, or a mixture or alloy thereof for the metal deposition layer, but usually aluminum is preferred.

The metal deposition layer can be formed by a physical deposition technique such as vacuum deposition, sputtering or ion plating, or chemical deposition technique.

The thickness of the metal deposition layer is preferably in the range of 10 to 200 nm, especially 30 to 100 nm. The hiding power of the metal deposition layer undesirably degrades when the thickness thereof is less than that range. The hiding property is not enhanced any more even when the thickness exceeds the range. Therefore, the metal deposition layer having too large a thickess is uneconomical and further degrades the selective transferability of the transfer layer.

The present invention can use any conventional heat-sensitive adhesive for the adhesive of the adhesive layer without any particular limitations.

Such an adhesive may comprise, as a main component, one or more resins or elastomers such as polyester resins, polyamide resins, epoxy resins, polyurethane resins, acrylic resins, vinyl chloride resins, cellulosic resins, polyvinyl alcohol resins, petroleum resins, ethylene-vinyl acetate copolymer resins, phenol resins, styrene resins, natural rubber, styrene-butadiene rubbers, isoprene rubber and chloroprene rubber, and as required a tackifier such as a rosin or a derivative thereof, terpene resin or hydrogenated petroleum resin, a plasticizer, an antioxidant and the like.

Preferably, the adhesive layer containing the aforesaid resin or elastomer as a main component is incorporated with fine particles. The incorporation of such fine particles improves the selective transferability of the adhesive layer and the antiblocking property thereof.

Usable as such fine particles are silica, talc, calcium carbonate, precipitated barium sulfate, alumina, clay, magnesium carbonate, carbon black, tin oxide, titanium oxide and the like. These materials may be used either alone or as a mixture.

The adhesive layer for use in the present invention may be one containing a wax as a main component. Usable as the wax are those aforementioned for the color ink layer.

The coating amount of the adhesive layer is suitably in the range of about 0.2 to about 2 g/m$^2$.

In the present invention, where the release property of the color ink layer from the foundation at the time of transfer is insufficient, it is preferable to provide a release layer intermediate the foundation and the color ink layer.

Usable as such a release layer are heat-meltable release layers each containing a wax as a main component. Such a wax can be selected from those aforementioned for the color ink layer. As required, the release layer may be incorporated with a small amount of a resin for the purpose of adjusting the adhesion between the release layer and the foundation or the color ink layer, or a like purpose. For such a resin can be used any of the aforementioned resins for the color ink layer.

The release layer preferably has a melting point of about 60° to about 120° C. and is used in a coating amount of about 0.2 to about 2 g/m$^2$.

In the present invention, preferably, another heat-meltable transparent ink layer is provided intermediate between the metal deposition layer and the adhesive layer. It has been found that the provision of such a transparent ink layer results in a print image which is further hardly affected by the color of the metal deposition layer unexpectedly, though the reason therefor is undetermined. Such a transparent ink layer can be of the same constitution as the formerly mentioned transparent ink layer.

The present invention can employ, as the foundation, polyester films such as polyethylene terephthalate film, polyethylene naphthalate film and polyarylate film, polycarbonate films, polyamide films and aramid films as well as other various plastic films usually used as foundation films of ink ribbons of this type. Alternatively, there may be used a high-density thin paper sheet such as a condenser paper. The foundation is preferably about 1 to about 10 μm thick, particularly about 2 to about 7 μm thick for good heat conduction.

Where there is used any of the foregoing plastic films as the foundation and the heating means is a thermal head, a stick-preventive layer may be provided on the back side (the side to be contacted by the thermal head) of the plastic film. Examples of the material for the stick-preventive layer include various heat-resistant resins such as silicone resin, fluorine-containing resin, nitrocellulose resin, other resins modified with these heat-resistant resins including silicone-modified urethane resins, and mixtures of the foregoing heat-resistant resins and lubricating agents.

The present invention will be described in more detail by way of examples and comparative examples. It is to be understood that the present invention will not be limited to these examples, and various changes and modifications may be made in the invention without departing from the spirit and scope thereof.

EXAMPLES 1–5 AND COMPARATIVE EXAMPLES 1–2

Onto the front side of a 6 μm-thick polyethylene terephthalate film having a 0.1 μm-thick silicone-modified urethane resin on the back side thereof was applied a solution of 80 parts by weight of a polyethylene wax and 20 parts by weight of ethylene-vinyl acetate copolymer in toluene, and then dried to form a release layer having a melting point of 80° C. in a coating amount of 0.4 g/m$^2$.

Onto the release layer was applied a coating liquid prepared by dissolving or dispersing a composition for color ink layer of the formulation shown in Table 1 in a mixed solvent of methyl ethyl ketone and toluene, and then dried to form a white ink layer having a softening point of 80° C.

Onto the white ink layer was applied a coating liquid prepared by dissolving or dispersing a composition for transparent ink layer of the formulation shown in Table 1 in a mixed solvent of methyl ethyl ketone and toluene, and then dried to form a transparent ink layer having a softening point of 80° C. In Comparative Examples 1 and 2 no transparent ink layer was provided.

On the transparent ink layer (on the color ink layer in Comparative Examples 1 and 2 ) was deposited aluminum to 80 nm thickness by vacuum vapor deposition to form an aluminum deposition layer, which was then coated with a coating liquid prepared by dissolving or dispersing 90 parts by weight of a polyester resin and 10 parts by weight of silica powder in a mixed solvent of methyl ethyl ketone and toluene and was then dried to form an adhesive layer having a softening point of 80° C. in a coating amount of 0.4 g/m$^2$. Thus, thermal transfer printing media were prepared.

The thermal transfer printing media thus prepared were slitted to afford ink ribbons of 18 mm wide.

Print images were formed on a black image-receiving medium (in which an image-receiving layer comprising a polyester resin was formed on the surface of a polyethylene terephthalate film coated black) in the form of tape using a commercially-available thermal transfer type tape printer equipped with a thermal head wherein each of the ink ribbons thus prepared was used, to evaluate the following items:

(1) Whiteness of print images

Solid printing was conducted. The reflection optical density (OD value) of the resulting print images was measured. The lower the OD value assumes, the better the whiteness is evaluated.

(2) Transferability

Halftone dot printing was conducted, and the obtained halftone dots were visually observed to evaluate the transferability of each ink ribbon, particularly the selective transferability of the transfer layer thereof on the basis of the following ratings:

1 . . . 100% of the halftone dots were collapsed;

2 . . . 50% of the halftone dots were collapsed;

3 . . . 20% of the halftone dots were collapsed;

4 . . . 10% of the halftone dots were collapsed; and

5 . . . The halftone dots were reproduced well.

TABLE 1

| | Example | | | | | Comparative Example | |
|---|---|---|---|---|---|---|---|
| | 1 | 2 | 3 | 4 | 5 | 1 | 2 |
| Color ink layer | | | | | | | |
| Composition (%) | | | | | | | |
| Polyester resin*1 | 15 | 15 | 15 | 15 | 15 | 15 | 15 |
| Titanium oxide | 85 | 85 | 85 | 85 | 85 | 85 | 85 |
| Coating amount (g/m$^2$) | 2.5 | 2.5 | 2.5 | 2.5 | 2.5 | 2.5 | 5 |
| Transparent ink layer | | | | | | | |
| Composition (%) | | | | | | | |
| Polyester resin*1 | 90 | 100 | 90 | 90 | 80 | — | — |
| Silica powder*2 | 10 | — | 10 | 10 | 20 | — | — |
| Coating amount (g/m$^2$) | 0.4 | 0.4 | 0.2 | 1 | 0.4 | — | — |
| Average transmittance (%) | 92 | 98 | 95 | 87 | 88 | — | — |
| Whiteness of print image (OD value) | 0.35 | 0.30 | 0.40 | 0.30 | 0.40 | 0.60 | 0.50 |
| Transferability | 4 | 3 | 5 | 3 | 5 | 5 | 4 |

*1softening point 80° C.
*2average particle size 0.1 μm

EXAMPLE 6

A thermal transfer printing medium was prepared in the same manner as in Example 1 except that a coating liquid prepared by dissolving or dispersing a composition for transparent ink layer of the formulation shown in Table 1 was further applied onto the aluminum deposition layer and then dried to form a transparent ink layer having a softening point of 80° C. in a coating amount of 0.4 g/m$^2$, followed by the formation of the adhesive layer.

When the thermal transfer printing medium thus prepared was subjected to the same test as the foregoing, the whiteness (OD value) of the resulting print images was 0.25 and the transferability thereof was rated 3.

EXAMPLE 7

A thermal transfer printing medium was prepared in the same manner as in Example 1 except that the composition for the color ink layer was replaced with the following composition to form a yellow ink layer having a softening point of 80° C. in a coating amount of 2.5 g/m$^2$.

| Ingredient | Parts by weight |
|---|---|
| Polyester resin | 50 |
| Disazo Yellow | 50 |

When the thermal transfer printing medium thus prepared was used in printing onto a black image-receiving medium in the same manner as in the foregoing, there were obtained print images in a color inherent to the yellow ink which was free from the influences of the color of the image-receiving medium and that of the aluminum deposition layer.

As has been described, a thermal transfer printing medium according to the present invention provides print images in a color free from the influences of the color of an image-receiving medium since a metal deposition layer having a high hiding power is provided as underlying a color ink layer.

Further, the provision of a transparent ink layer intermediate between the color ink layer and the metal deposition layer affords print images in a color inherent to the color ink layer without being influenced by the metal deposition layer.

What is claimed is:

1. A thermal transfer printing medium comprising a foundation and a transfer layer provided on one side of the foundation, said transfer layer comprising, in order from the foundation side, a heat-meltable color ink layer having hiding power, a heat-meltable transparent ink layer, a metal deposition layer, a transparent ink layer and an adhesive layer, said color ink layer containing about 50 to about 90% by weight of a coloring agent.

2. The thermal transfer printing medium of claim 1, wherein the coating amount of said transparent ink layer is about 0.1 g/m$^2$ or greater on a dry weight basis.

3. The thermal transfer printing medium of claim 1, wherein the coating amount of the color ink layer is from 2 to 6 g/m$^2$.

4. The thermal transfer printing medium of claim 1, wherein the color ink layer is a white ink layer.

5. The thermal transfer printing medium of claim 1, wherein the color ink layer is a chromatic ink layer.

6. The thermal transfer printing medium of claim 1, wherein said printing medium further comprises a release layer provided intermediate between said foundation and said heat-meltable color ink layer.

* * * * *